US008840240B2

(12) United States Patent
Kawakami

(10) Patent No.: US 8,840,240 B2
(45) Date of Patent: Sep. 23, 2014

(54) PAPER CONVEYANCE DEVICE AND PRINTER

(75) Inventor: Hideki Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 248 days.

(21) Appl. No.: 13/229,599

(22) Filed: Sep. 9, 2011

(65) Prior Publication Data

US 2012/0062675 A1 Mar. 15, 2012

(30) Foreign Application Priority Data

Sep. 10, 2010 (JP) ..... 2010-202773

(51) Int. Cl.
*B41J 2/01* (2006.01)
*B41J 15/04* (2006.01)
*B41J 11/42* (2006.01)

(52) U.S. Cl.
CPC . *B41J 11/42* (2013.01); *B41J 15/04* (2013.01)
USPC ..... 347/104

(58) Field of Classification Search
CPC ..... B41J 29/393; B41J 11/006; B41J 2/01
USPC ..... 347/104; 400/583, 616.2; 271/115, 266; 226/74, 76
See application file for complete search history.

(56) References Cited

U.S. PATENT DOCUMENTS 4,941,377 A * 7/1990 Ishihara et al. ..... 83/211
5,194,903 A * 3/1993 Negishi et al. ..... 399/384
5,779,378 A * 7/1998 Kikuchi ..... 400/616.2
6,000,595 A * 12/1999 Crowley et al. ..... 226/15
6,224,051 B1 * 5/2001 Nakayama et al. ..... 271/115
2006/0221412 A1 * 10/2006 Terada ..... 358/498

FOREIGN PATENT DOCUMENTS

JP 04-156364 A 5/1992
JP 09-086003 A 3/1997
JP 2002-348012 * 4/2002 ..... B65H 27/00
JP 2002348012 A * 12/2002
JP 2005-138942 A 6/2005
JP 2006-232470 A 9/2006
JP 2008-168497 A 7/2008
JP 2009-119574 A 6/2009

OTHER PUBLICATIONS

"MachineTranslationofJP2002-348012.pdf", Apr. 12, 2002.*

* cited by examiner

*Primary Examiner* — Geoffrey Mruk
*Assistant Examiner* — Scott A Richmond
(74) *Attorney, Agent, or Firm* — Kilpatrick Townsend & Stockton LLP

(57) ABSTRACT

A paper conveyance device for a printing device is disclosed that includes a detector and first, second, and third conveyance mechanisms. The first conveyance mechanism includes a tractor that conveys continuous paper along a paper feed direction. The second conveyance mechanism is disposed between the first conveyance mechanism and a print head and includes feed and pressure rollers. The third conveyance mechanism is disposed downstream from the print head and includes feed and pressure rollers. The detector detects the paper feed distance of the first conveyance mechanism and the rotation of the feed roller of the second conveyance mechanism, and adjusts the paper feed distance of the first conveyance mechanism based on the detected paper feed distance. A paper feed distance per unit time of each of the second and third conveyance mechanisms is greater than a paper feed distance per unit time of the first conveyance mechanism.

18 Claims, 7 Drawing Sheets

PAPER CONVEYANCE DEVICE AND PRINTER

This application claims priority to Japanese Patent Application No. 2010-202773, filed Sep. 10, 2010, the entirety of which is incorporated by reference herein.

BACKGROUND

1. Technical Field

The present invention relates to a paper conveyance device for continuous paper, and to a printer having the paper conveyance device.

2. Related Art

Folded continuous paper with sprocket holes, commonly known as fanfold paper, is used as a recording medium in business printers, a type of printing device. Fanfold paper is perforated between each page so that it can be severed, and is stored in a stack in the paper supply unit of the printer with the pages alternately folded in opposite directions at the perforations. Fanfold paper is conveyed by a paper conveyance mechanism with a tractor.

The tractor has tractor pins (engaging units) that can be inserted in the sprocket holes (engagement holes) formed in the paper feed direction of the continuous paper; a tractor belt having the tractor pins formed with a specific interval there between on the outside surface; and a drive sprocket and follower sprocket on which the tractor belt is mounted. The continuous paper is set so that the tractor pins are inserted in the sprocket holes. When the continuous paper is set, the tractor causes the tractor belt to turn by driving the drive sprocket rotationally by means of drive power from a drive source, and conveys the continuous paper while causing the tractor pins to sequentially engage the sprocket holes of the continuous paper. See, for example, Japanese Unexamined Patent Appl. Pub. JP-A-2006-232470.

The paper conveyance device of a business printer that records information on continuous paper has a feed roller near the print head in addition to the tractor described above, and feeds the continuous paper in increments of a specific feed distance by synchronously driving the feed roller and the tractor. See, for example, Japanese Unexamined Patent Appl. Pub. JP-A-2009-119574.

Fanfold paper used as continuous paper includes multipart forms made with carbonless paper using a leuco dye and developer reaction, for example, or carbon paper having a carbon ink coating on the back of the paper. When pressure is applied to carbonless paper or carbon paper by the metal pins of the dot impact head of an impact printer, for example, color is produced where pressure is applied, and information is printed in duplicate.

Applications for business printers have expanded in recent years, including, for example, the desire to print a wider variety of information and image information. As a result, printing with greater precision and higher density is desired. Many different kinds of recording media are also used, and it is desirable to, for example, use fanfold paper having sheets of different materials for prescription bags so that information can be printed on the envelope while feeding the paper through a business printer. High precision paper conveyance is therefore desirable.

The paper conveyance mechanism described above is also subject to variation in the paper feed distance of the tractor and the paper feed distance of the feed roller due to deviation in parts precision, for example. In addition, when the fanfold paper consists of two combined sheets of different kinds of materials, the paper feed distance of the portion to be printed can also vary due to differences in the friction coefficients of the sheets or differences in the coefficient of expansion caused by humidity. A problem is that variation in the paper feed distance leads to a drop in print quality.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention is directed to solving at least part of the foregoing problem, and can be achieved by the embodiments and examples described below.

In one aspect of the invention, a paper conveyance device for a printing device is disclosed. The printing device has a print head that prints information on conveyed continuous paper. The paper conveyance device includes a first conveyance mechanism, a second conveyance mechanism, a third conveyance mechanism, and a detector. The first conveyance mechanism includes a tractor that sequentially engages holes formed in the continuous paper and conveys the continuous paper along a paper feed direction. A paper feed distance per unit time of the first conveyance mechanism is a reference paper feed distance per unit time. The second conveyance mechanism includes a first feed roller and a first pressure roller. The second conveyance mechanism is disposed between the first conveyance mechanism and the print head in the paper feed direction. A paper feed distance per unit time of the second conveyance mechanism is greater than the reference paper feed distance per unit time. The third conveyance mechanism includes a second feed roller and a second pressure roller. The third conveyance mechanism is disposed downstream in the paper feed direction from the print head. A paper feed distance per unit time of the third conveyance mechanism is greater than the reference paper feed distance per unit time. The detector detects a paper feed distance of the first conveyance mechanism and a rotation of the first feed roller and the paper feed distance of the first conveyance mechanism is adjusted based on the detected paper feed distance.

The paper conveyance device uses the first conveyance mechanism as the main conveyance mechanism. This assures the desired paper feed distance and paper feed force on the continuous paper. Each of the second and third conveyance mechanisms is configured to, in the absence of the restraint on the paper provided by the first conveyance mechanism, convey the continuous paper at a rate slightly greater than the conveyance rate of the first conveyance mechanism. Due to the positive restraint provided by the first conveyance mechanism and the ability of the paper to slip relative to the second and third conveyance mechanisms, the combination of the first, second, and third conveyance mechanisms produces tension in the continuous paper between the first conveyance mechanism and the third conveyance mechanism. The difference between the paper feed rate of the first conveyance mechanism and the paper feed rates of the second and third conveyance mechanisms is preferably small. As a result, a suitable level of tension can be applied to the conveyed continuous paper on the paper conveyance path from the first conveyance mechanism to the third conveyance mechanism including the printing position. Problems such as folds, wrinkles, or slack in the continuous paper resulting from conveyance are reduced by this tension. As a result, continuous paper can be conveyed with few folds, wrinkles, or slack.

The tractor of the first conveyance mechanism constrains the position of the conveyed continuous paper along the feed direction. In contrast, the second conveyance mechanism and the third conveyance mechanism are used to generate tension in the conveyed continuous paper and do not positively constrain the conveyed continuous paper along the feed direction because the paper can slip relative to the rollers of the second and third conveyance mechanisms. The continuous paper is therefore held by the first conveyance mechanism, and slight slipping occurs between the conveyed continuous paper and the rollers of the second and third conveyance mechanisms. As a result, continuous paper can be conveyed in the paper conveyance device at the desired paper feed amount set by the first conveyance mechanism. More specifically, continuous paper can be conveyed a reference paper feed amount while maintaining a suitable level of tension in the continuous paper. A printing device using this paper conveyance device can therefore assure the desired paper feed precision while reducing printing problems caused by folds, wrinkles, or slack in the continuous paper, and can assure good print quality.

In many embodiments, the second and third conveyance mechanisms are configured to have specific characteristics. For example, the paper feed distance per unit time of the third conveyance mechanism can be greater than the paper feed distance per unit time of the second conveyance mechanism, thereby serving to more quickly generate a suitable level of tension in the conveyed continuous paper between the second conveyance mechanism and the third conveyance mechanism. As another example, a combined maximum paper holding force of the second and third conveyance mechanisms can be set to be suitably below a maximum paper holding force of the first conveyance mechanism so that the continuous paper will slip relative to the rollers of the second and third conveyance mechanisms before the resultant tension in the continuous paper between the first conveyance mechanism and the second conveyance mechanism exceeds a maximum paper holding force of the first conveyance mechanism. By ensuring that the continuous paper will slip relative to the rollers of the second and third conveyance mechanisms before the maximum paper holding force of the first conveyance mechanism is exceed, corresponding damage to the continuous paper (e.g., torn holes) may be prevented. And the maximum paper holding force of the third conveyance mechanism can be less that the maximum paper holding force of the second conveyance mechanism (e.g., by having the pressure of the second pressure roller on the second feed roller be less than the pressure of the first pressure roller on the first feed roller).

In addition, the detector is used to detect the actual paper feed distance by the first conveyance mechanism and the rotation of the first feed roller of the second conveyance mechanism. And based on the detected result, the paper feed amount of the first conveyance mechanism can be adjusted. As a result, the actual paper feed distance and slipping can be monitored even in a configuration that causes slipping in the second conveyance mechanism, and the paper feed amount of the first conveyance mechanism can be adjusted when a difference to the reference paper feed amount occurs. As a result, high precision paper conveyance is possible.

In the foregoing paper conveyance device, the pressure of the first pressure roller of the second conveyance mechanism on the first feed roller can be greater than the pressure of the second pressure roller of the third conveyance mechanism on the second feed roller.

With this configuration the paper holding force of the second conveyance mechanism can be set greater than the paper holding force of the third conveyance mechanism.

In the foregoing paper conveyance device, the first conveyance mechanism and the second conveyance mechanism can be driven by a common drive source, the detector can include a rotary encoder that detects the rotation of the first feed roller, and the rotary encoder can detect the paper feed distance of the first conveyance mechanism.

In the foregoing paper conveyance device, the first conveyance mechanism can include a first drive gear that drives the tractor, the second conveyance mechanism can include a second drive gear that drives the first feed roller, the common drive source can include a motor that drives a motor gear; and a single toothed belt can be mounted on the first drive gear, second drive gear, and motor gear.

With these configurations, drive power from a motor, which is a common drive power source, can be directly transferred from the motor gear through the toothed belt to the first conveyance mechanism and second conveyance mechanism. A detector disposed to the feed roller of the second conveyance mechanism can detect the actual paper feed distance of the first conveyance mechanism and the rotation of the first feed roller of the second conveyance mechanism. The actual paper feed distance and slipping at the second conveyance mechanism can therefore be monitored. As a result, when a difference to the reference paper feed amount occurs due to variation in the load or slipping, the paper feed amount of the first conveyance mechanism can be adjusted. High precision paper conveyance can therefore be achieved.

In another aspect of the invention, a printing device is disclosed. The printing device can include any one of the paper conveyance devices described herein, a print head that discharges ink droplets onto the continuous paper conveyed by the paper conveyance device; a carriage that carries the print head, and a carriage moving mechanism that moves the carriage bidirectionally in a direction perpendicular to the paper feed direction of the paper conveyance device.

The printing device can apply specific tension to the conveyed continuous paper, and can reduce problems such as folds, wrinkles, and slack in the continuous paper. The actual paper feed distance and slipping at the second conveyance mechanism can also be monitored, and error can be eliminated when there is a difference between the actual paper feed distance and the reference paper feed distance. The printer can therefore reduce printing problems caused by folds, wrinkles, or slack in continuous paper, can assure paper feed precision, and can achieve high print quality.

For a fuller understanding of the nature and advantages of the present invention, reference should be made to the ensuing detailed description and accompanying drawings.

DESCRIPTION OF EMBODIMENTS

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

A preferred embodiment of the invention is described below with reference to the accompanying figures. Note that for convenience of description and illustration, the horizontal and vertical scale of members and parts may be shown as different from the actual scale in the figures referenced in the following description. Note that an inkjet printer that prints by ejecting ink droplets onto paper is used as an example of a printing device in the embodiment described below.

General Configuration of an Inkjet Printer

Figure 1:
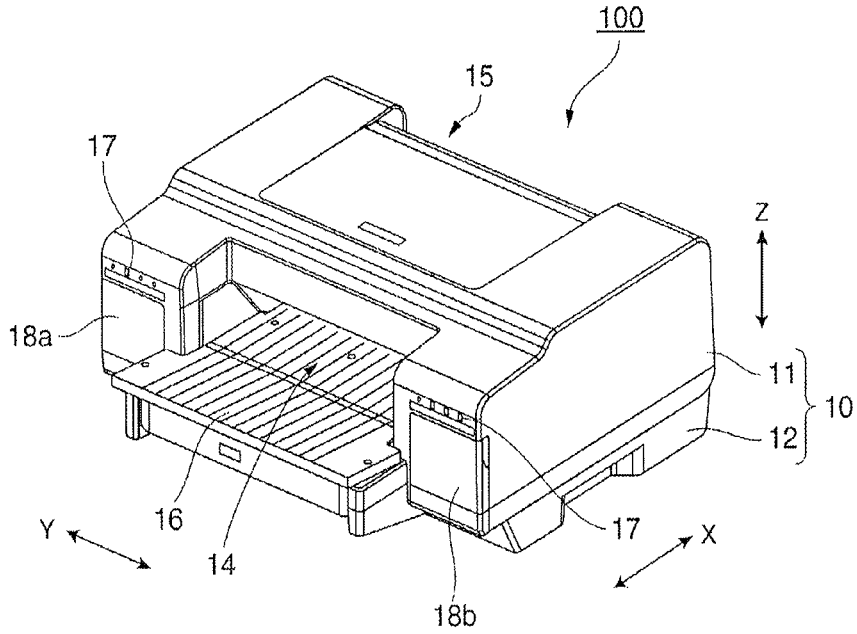
FIG. 1 is an external oblique view of an inkjet printer, in accordance with an embodiment.

The general configuration of an inkjet printer is described next with reference to FIG. 1. FIG. 1 is an external oblique view of an inkjet printer. Note that the x-axis shown in FIG. 1 denotes the paper feed direction of the continuous paper, the y-axis indicates the direction of the width of the continuous paper, and the z-axis indicates the axis perpendicular to the x-axis and y-axis.

An inkjet printer 100 according to this embodiment of the invention is a business printer of a type that supplies fanfold paper used as continuous paper from the back side of the printer and discharges the paper from the front of the printer. As shown in FIG. 1, the inkjet printer 100 stores the print unit 110 (see FIG. 2) described below inside a case 10 composed of a top case 11 and a bottom case 12. A paper exit 14 opens to the front center of the case 10 as seen in the figure, and a paper supply opening 15 is rendered behind the paper exit 14 on the x-axis. A discharge tray 16 that receives the continuous paper after printing is completed is disposed to the paper exit 14. A display unit 17 composed of LED indicators, for example, for displaying the operating state is disposed to the front of the case 10 on both sides on the y-axis.

An ink cover 18*a* that covers the front of the cartridge storage unit 22*a* that stores a black ink cartridge 21*a*, and an ink cover 18*b* that covers the front of a cartridge storage unit 22*b* (see FIG. 2) the stores a plurality of color ink cartridges 21*b*, are disposed on the left and right sides below the display unit 17 on the z-axis. These ink covers 18*a*, 18*b* are attached so that they can open and close, and the ink cartridges 21*a*, 21*b* can be replaced by opening the respective ink covers 18*a*, 18*b*.

Configuration of the Print Unit

Figure 2:
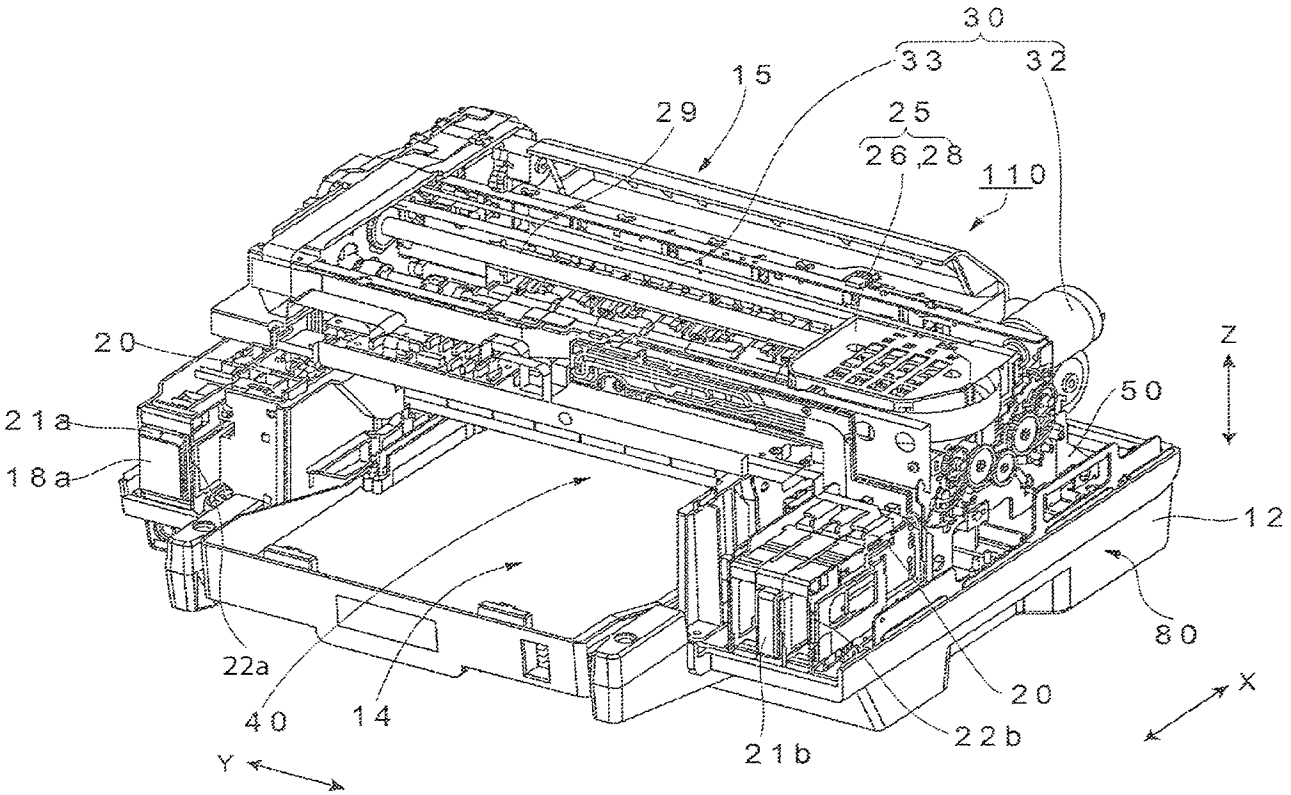
FIG. 2 is an oblique view of a print unit of the inkjet printer of FIG. 1.

The configuration of the print unit housed in the case is described next with reference to FIG. 2. FIG. 2 is an oblique view of the print unit. Note that the x-axis, y-axis, and z-axis shown in FIG. 2 denote the same directions as the x-axis, y-axis, and z-axis shown in FIG. 1.

As shown in FIG. 2, the print unit 110 has an ink supply mechanism 20, a print mechanism 25, a waste ink tank, a paper conveyance device 40, a chassis 50, and a control device 80.

The ink supply mechanism 20 includes cartridge storage units 22*a*, 22*b* that hold the ink cartridges 21*a*, 21*b*, an ink pressurization unit not shown, and an ink supply tube that is also not shown. The cartridge storage units 22*a*, 22*b* are respectively disposed behind the foregoing ink covers 18*a*, 18*b*. Ink from the ink cartridges 21*a*, 21*b* stored in the cartridge storage units 22*a*, 22*b* is pressurized by the ink pressurization unit and supplied through the ink supply tube to the print mechanism 25.

The print mechanism 25 includes an inkjet head 26, carriage 28, carriage drive mechanism 30, and maintenance mechanism not shown. The inkjet head 26 has a plurality of nozzles 27 (see FIG. 3) that eject ink supplied by the ink supply mechanism 20 as ink droplets, and is mounted on the carriage 28 with the nozzles 27 facing down on the z-axis in FIG. 2, that is, facing the continuous paper. The carriage 28 is movably supported on a carriage shaft 29 that extends in the direction of the paper width (the y-axis), and is moved bidirectionally on the y-axis by the carriage drive mechanism 30. The carriage drive mechanism 30 includes a carriage motor 32, and a timing belt 33 that is driven by the carriage motor 32. The carriage 28 is fastened to the timing belt 33, and therefore moves bidirectionally in the paper width direction (y-axis) in conjunction with timing belt 33 travel.

The maintenance mechanism includes a suction unit not shown and a wiper unit also not shown. The maintenance mechanism can set the suction unit and wiper unit opposite the inkjet head 26 on the carriage 28 by moving the carriage 28 on the y-axis. The suction unit functions to seal the nozzle 27 face of the inkjet head 26 when not printing to prevent the nozzles 27 from drying, and suction ink that has increased in viscosity from the nozzles 27 of the inkjet head 26. The wiper unit functions to wipe waste from the nozzle 27 face of the inkjet head 26. The waste ink tank has a piece of felt or other non-woven cloth, is disposed at the bottom of the print unit 110, and stores waste ink removed by the suction unit.

Configuration of the Paper Conveyance Device

Figure 3:
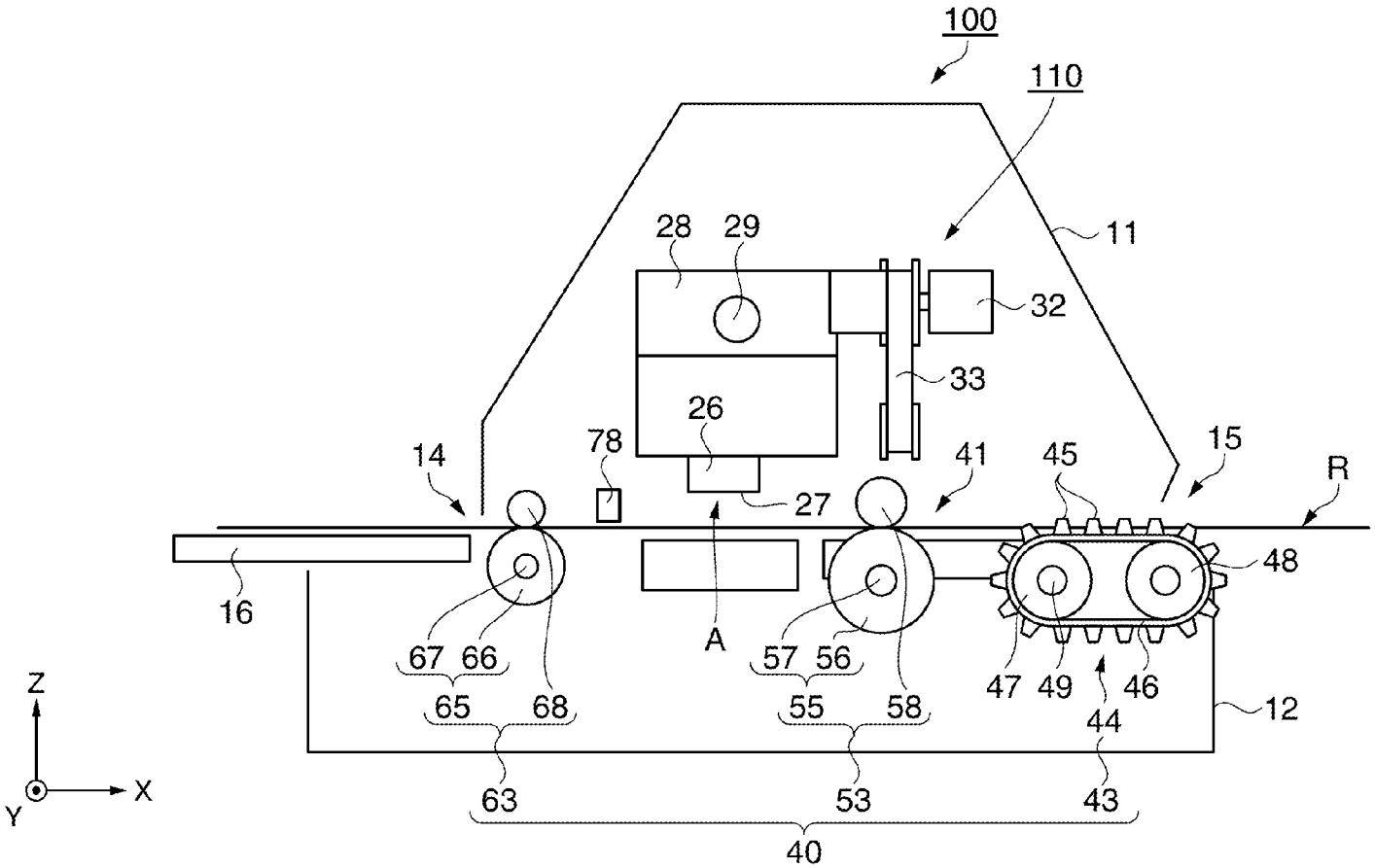
FIG. 3 schematically shows the configuration of a paper conveyance device of the inkjet printer of FIG. 1.
Figure 4:
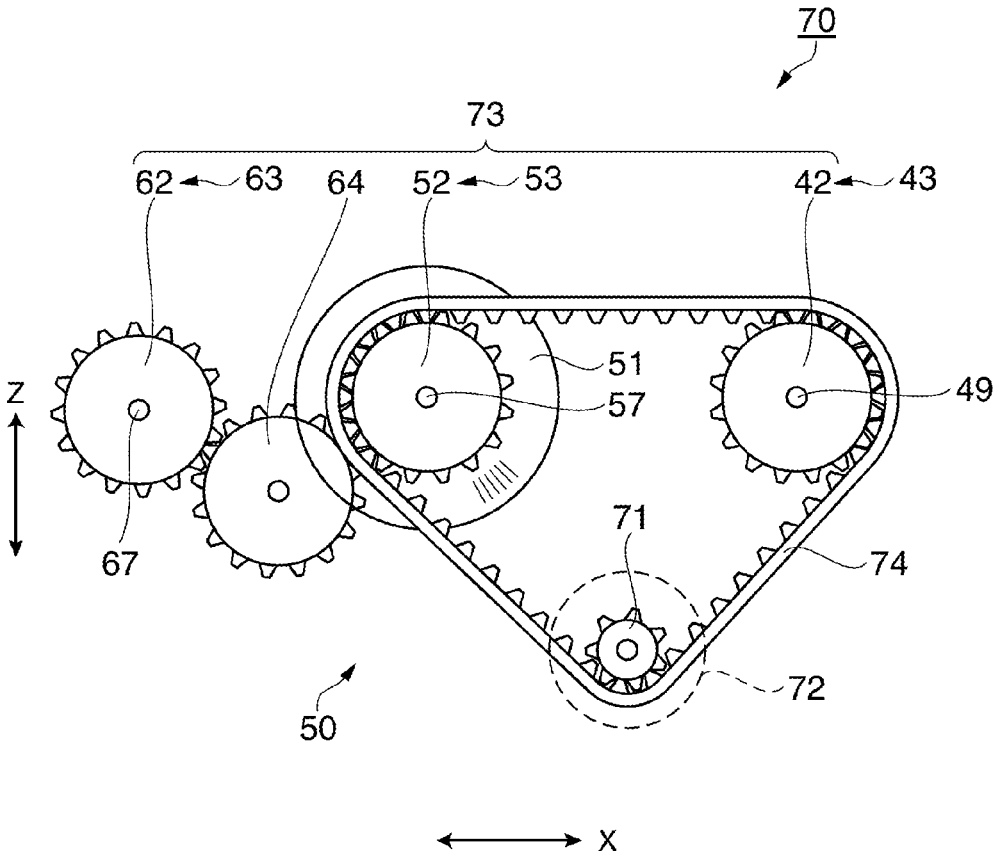
FIG. 4 shows the configuration of a power transfer mechanism of the paper conveyance device of FIG. 3.

The configuration of the paper conveyance device is described next with reference to FIG. 3 and FIG. 4. FIG. 3 schematically shows the configuration of the paper conveyance device, and FIG. 4 shows the configuration of the power transfer mechanism of the paper conveyance device. Note that the x-axis, y-axis, and z-axis shown in FIG. 3 and FIG. 4 denote the same directions as the x-axis, y-axis, and z-axis shown in FIG. 1. Note also that this paper conveyance device conveys continuous paper R that has sprocket holes (engagement holes).

As shown in FIG. 3, the paper conveyance device 40 has a paper conveyance path 41, a first conveyance mechanism 43, a second conveyance mechanism 53, a third conveyance mechanism 63, and a power transfer mechanism 70 (see FIG. 4). The paper conveyance path 41 is formed along the x-axis shown in FIG. 3 starting from the paper supply opening 15 of the inkjet printer 100 and print unit 110 shown in FIG. 1 and FIG. 2, passing the printing position A of the inkjet head 26 of the print mechanism 25, and ending at the paper exit 14. Disposed along the paper conveyance path 41 sequentially from the upstream side to the downstream side are a first conveyance mechanism 43, second conveyance mechanism 53, print mechanism 25, and third conveyance mechanism 63.

The first conveyance mechanism 43 is disposed near the paper supply opening 15, and has a pair of tractors 44. Each tractor 44 has tractor pins 45 (engaging units) that can be inserted to the sprocket holes Q1 of the continuous paper R, a tractor belt 46 on the outside surface of which the tractor pins 45 are formed at a regular interval, and a drive sprocket 47 and follower sprocket 48 on which the tractor belt 46 is mounted. The pair of tractors 44 is disposed on both sides of the paper conveyance path 41 on the y-axis opposite the sprocket holes Q1 on both sides of the width of the conveyed continuous paper R. The drive sprockets 47 of the tractor 44 pair are connected to each other by a drive sprocket shaft 49 so that the pair of tractors 44 are driven synchronously. A drive gear 42 (see FIG. 4) is attached to an end of the drive sprocket shaft 49 so that it is exposed from one outside surface of the chassis 50.

The second conveyance mechanism 53 is disposed to the paper conveyance path 41 between the first conveyance mechanism 43 and the printing position A of the inkjet head 26, and more specifically slightly to the inkjet head 26 side. The second conveyance mechanism 53 has a first paper feed roller 55 and a first pressure roller 58. The first paper feed roller 55 is composed of a cylindrical roller 56 made from a rubber elastic body or a sintered body with a powder coating, and a roller shaft 57 that passes axially through the roller 56, and is disposed transversely to the paper conveyance path 41 below the paper conveyance path 41 on the z-axis.

The drive gear 52 (see FIG. 4) is disposed to one end of the roller shaft 57 so that it is exposed outside of one side of the chassis 50. A rotary encoder (detector) 51 (see FIG. 4) is mounted on the drive gear 52 to detect the rotation of the first paper feed roller 55 (the paper feed distance of the second conveyance mechanism 53). The first pressure roller 58 has an axially supported cylindrical roller made of rubber or other elastic body, and is disposed to press the continuous paper R conveyed through the paper conveyance path 41 to the first paper feed roller 55 by an urging force applied from above on the z-axis.

The third conveyance mechanism 63 is disposed along the paper conveyance path 41 between the printing position A of the inkjet head 26 and the paper exit 14, and more specifically slightly to the inkjet head 26 side. The third conveyance mechanism 63 has a second paper feed roller 65 and a second pressure roller 68. The second paper feed roller 65 includes a cylindrical roller 66 made from a rubber elastic body or a sintered body with a powder coating, and a roller shaft 67 that passes axially through the cylindrical roller 66, and is disposed transversely to the paper conveyance path 41 below the paper conveyance path 41 on the z-axis. A drive gear 62 (see FIG. 4) is attached to one end of the roller shaft 67 so that it is exposed from one outside surface of the chassis 50.

The second pressure roller 68 is a toothed roller made by sheet metal processing metal sheets into star shapes, and is disposed to press the continuous paper R fed through the paper conveyance path 41 to the second paper feed roller 65 by means of urging force from above on the z-axis. A paper detector 78 is disposed between the second pressure roller 68 and the inkjet head 26. The paper detector 78 is a reflective photo sensor, for example, and detects the presence and the leading edge or the trailing edge of continuous paper R conveyed through the paper conveyance path 41 by the paper conveyance device 40.

As shown in FIG. 4, the power transfer mechanism 70 includes a paper feed motor 72 with a motor gear 71 as the drive source, a gear train 73, and a toothed belt 74, and is disposed outside the chassis 50 on one side on the y-axis. The paper feed motor 72 is fastened to the chassis 50 so that the motor gear 71 is exposed outside one side of the chassis 50. As a result, the motor gear 71 and the gear train 73 including the drive gear 42 described above, the drive gear 52, and the drive gear 62 are disposed outside one side of the chassis 50. The toothed belt 74 is an endless belt with internal teeth, and is mounted with specific tension to the motor gear 71, the drive gear 42 of the first conveyance mechanism 43, and the drive gear 52 of the second conveyance mechanism 53. The drive gear 62 of the third conveyance mechanism 63 engages the drive gear 52 of the second conveyance mechanism 53. Note that a tension roller could be used with the toothed belt 74 to maintain appropriate tension.

The paper conveyance device 40 configured as described above directly transfers the drive power of the paper feed motor 72 from the motor gear 71 through the toothed belt 74 to the drive gear 42 of the first conveyance mechanism 43 and the drive gear 52 of the second conveyance mechanism 53, and to the drive gear 62 of the third conveyance mechanism 63 through the drive gear 52 of the second conveyance mechanism 53. Note that the paper feed motor 72 is controlled based on a control signal from the control device 80 described below.

The paper conveyance device 40 conveys continuous paper R with sprocket holes Q1 that are engaged by the tractor pins 45 along the paper conveyance path 41 by rotationally driving the tractors 44 of the first conveyance mechanism 43. The continuous paper R conveyed by the first conveyance mechanism 43 is delivered between the rotating first paper feed roller 55 and first pressure roller 58 of the second conveyance mechanism 53, and is further conveyed through the paper conveyance path 41. The continuous paper R conveyed by the second conveyance mechanism 53 is fed passed the printing position A of the print mechanism 25 to between the rotating second paper feed roller 65 and second pressure roller 68 of the third conveyance mechanism 63, and is sequentially conveyed through the paper conveyance path 41 toward the paper exit 14.

Note that the paper conveyance device 40 in this embodiment of the invention uses the first conveyance mechanism 43 as the main conveyance mechanism. More specifically, the paper feed distance per unit time by the tractors 44 of the first conveyance mechanism 43 is set as the reference paper feed distance T1 for printing by the print mechanism 25. If the paper feed distance per unit time of the first paper feed roller 55 of the second conveyance mechanism 53 is paper feed distance T2, and the paper feed distance per unit time of the second paper feed roller 65 of the third conveyance mechanism 63 is paper feed distance T3, in many embodiments, the paper feed distance T2 is greater than the paper feed distance T1, and the paper feed distance T3 is greater than the paper feed distance T1. And in many embodiments, the paper feed distance T3 is greater than the paper feed distance T2, and the paper feed distance T2 is greater than the paper feed distance T1 so that there is a difference between the respective paper feed amounts.

The respective paper feed amounts can be adjusted by controlling the number of teeth (speed reducing ratio) on the drive gear 42 of the first conveyance mechanism 43 and the drive gear 52 of the second conveyance mechanism 53, which are rotationally driven by the toothed belt 74, and the drive gear 62 of the third conveyance mechanism 63, which is rotationally driven by the drive gear 52 of the second conveyance mechanism 53. Adjustment is also possible using the pitch of the tractor pins 45 formed on the tractor belt 46 and the diameters of the first paper feed roller 55 and the second paper feed roller 65. Note that in this embodiment of the invention paper feed distance T2 is approximately 1% greater, and paper feed distance T3 is approximately 2.5% greater, than reference paper feed distance T1. Note, further, that these numbers are used for example only and the invention is not limited thereto.

In addition, if the paper holding force of the tractors 44 of the first conveyance mechanism 43 is paper holding force F1, the paper holding force of the first paper feed roller 55 and first pressure roller 58 of the second conveyance mechanism 53 is paper holding force F2, and the paper holding force of the second paper feed roller 65 and second pressure roller 68 of the third conveyance mechanism 63 is paper holding force F3, a difference between the paper holding forces can be created so that paper holding force F1 is greater than the paper holding force F2, and so that the paper holding force F2 is greater than the paper holding force F3. Note that the paper holding force F is determined by the pressure applied by the pressure roller and the material and shape of the pressure roller, and is substantially proportional to paper feed force G. Note that the main paper feed force is preferably the paper feed force G1 of the tractors 44 of the first conveyance mechanism 43, and the continuous paper R is conveyed through the paper conveyance path 41 by using only paper feed force G1. The paper holding force F1 of the tractors 44 of the first conveyance mechanism 43 is greatest because the sprocket holes Q1 of the continuous paper R are engaged by the tractor pins 45 of the tractors 44. The paper holding force F2 of the second conveyance mechanism 53 is adjusted by the pressure (urging force) of the first pressure roller 58 against the first paper feed roller 55, and the paper holding force F3 of the third conveyance mechanism 63 is adjusted by the pressure (urging force) of the second pressure roller 68 against the second paper feed roller 65. In many embodiments, the paper holding force F2 of the second conveyance mechanism 53 is set to approximately two to three times the paper holding force F3 of the third conveyance mechanism 63. Note, further, that these numbers are used for example only and the invention is not limited thereto.

As described above, the paper conveyance device 40 uses conveyance by the tractors 44 of the first conveyance mechanism 43 as the main conveyance force, and conveyance by the second conveyance mechanism 53 and third conveyance mechanism 63 as a secondary conveyance force. In addition, in the relationship between the second conveyance mechanism 53 and the third conveyance mechanism 63, the third conveyance mechanism 63 provides a secondary conveyance force for the second conveyance mechanism 53.

More specifically, the first conveyance mechanism 43 assures the desired paper feed distance T1 and paper holding force F1 to the continuous paper R while the second conveyance mechanism 53 feeds the continuous paper R a slightly greater paper feed distance T2 than the first conveyance mechanism 43. At the same time, the first conveyance mechanism 43 can apply specified tension to the continuous paper R because the sprocket holes Q1 are engaged by the tractor pins 45 of the tractors 44. Because the paper holding force F2 of the second conveyance mechanism 53 is lower than the paper holding force F1 of the first conveyance mechanism 43, the continuous paper R slips between the first paper feed roller 55 and first pressure roller 58, and paper feed distance T1 is sustained while maintaining tension. As a result, folds, wrinkles, and slack at the perforations in the continuous paper R can be prevented between the first conveyance mechanism 43 and the second conveyance mechanism 53.

In addition, while the first conveyance mechanism 43 assures the desired continuous paper R feed distance T1 and paper holding force F1, and the second conveyance mechanism 53 slips against the continuous paper R, the third conveyance mechanism 63 conveys the continuous paper R a slightly greater amount than the second conveyance mechanism 53. However, because the sprocket holes Q1 of the continuous paper R are engaged by the tractor pins 45 of the tractors 44 in the first conveyance mechanism 43, the continuous paper R receives a certain amount of tension from the third conveyance mechanism 63. Because the paper holding force F3 of the third conveyance mechanism 63 is lower than the paper holding force F2 of the second conveyance mechanism 53, the continuous paper R slips between the second paper feed roller 65 and the second pressure roller 68, and the paper feed distance T1 is maintained while holding the tension. As a result, folds, wrinkles, and slack at the perforations in the continuous paper R can be prevented between the second conveyance mechanism 53 and the third conveyance mechanism 63.

Continuous Paper

Figure 5A:
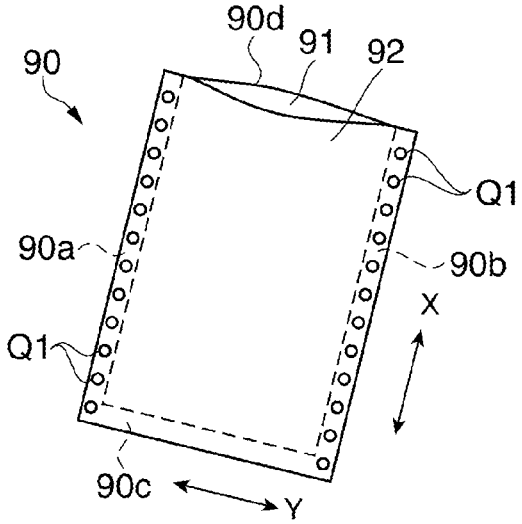
FIG. 5 shows an example of continuous paper.
Figure 5B:
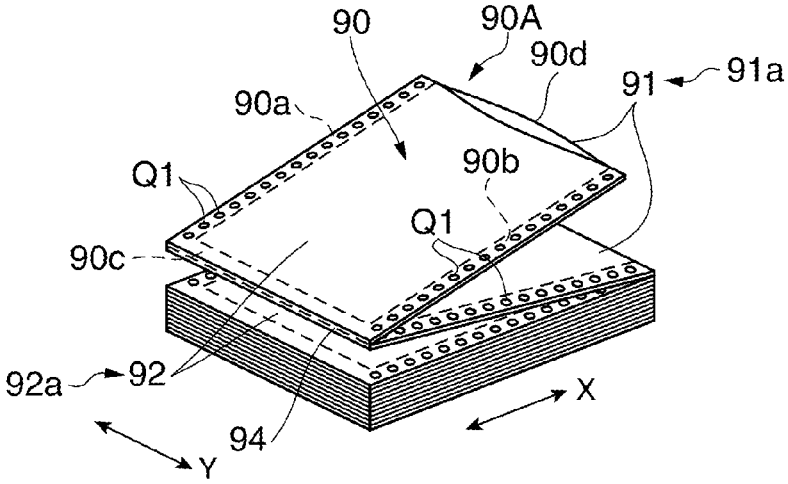
Figure 5C:
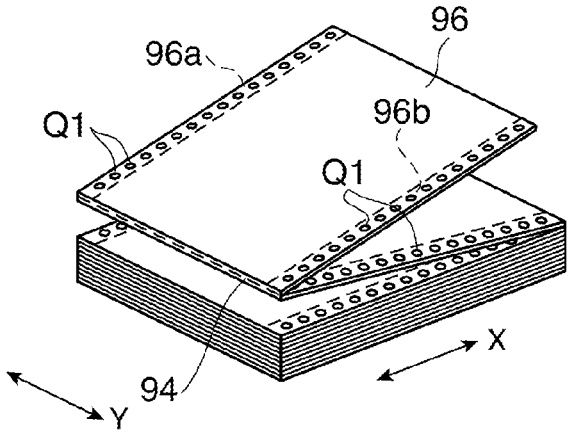

The continuous paper used in the foregoing inkjet printer is described next with reference to FIG. 5A to FIG. 5C. FIG. 5 shows examples of continuous paper, FIG. 5A showing a single prescription bag, FIG. 5B showing prescription bags as continuous paper, and FIG. 5C showing fanfold paper as continuous paper. Note that the x-axis, y-axis, and z-axis shown in FIG. 5 denote the same directions as the x-axis, y-axis, and z-axis shown in FIG. 1.

A prescription bag 90 is a paper bag used to hold prescription drugs received from a hospital or pharmacy for a patient, and has the patient name, drug information, and dosage instructions recorded on the outside. As shown in FIG. 5A, the prescription bag 90 has a double-layered construction including a transparent plastic film sheet 91 and a paper cover sheet 92 that are bonded with adhesive along both y-axis edges 90*a*, 90*b* and x-axis bottom edge 90*c*, leaving the x-axis top end 90*d* open. The patient name and other necessary information is printed on the cover sheet 92 by the inkjet printer 100 described above, and the prescriptions stored inside can be seen through the transparent plastic film sheet 91.

As shown in FIG. 5B, the prescription bags 90 are supplied as continuous prescription bag paper 90A having plural sets of the foregoing prescription bags 90 formed continuously together. More specifically, the transparent plastic film sheet 91 and cover sheet 92 are each single continuous webs 91*a*, 92*a*, respectively, that are bonded to each other with adhesive along the edges 90*a*, 90*b* and have sprocket holes Q1 that can be engaged by the tractor pins 45 shown in FIG. 3 formed in a line at a specific pitch along the edges 90*a*, 90*b* on the x-axis. These continuous webs 91*a*, 92*a* can be individually separated at the perforations (separation parts) 94 disposed at specific intervals lengthwise (on the x-axis). The sheets are also bonded with adhesive widthwise on one side of each perforation 94. This bonded part corresponds to the bottom edge 90*c*. The continuous prescription bag paper 90A is alternately folded in opposite directions at the perforations 94 like fanfold paper. Thus configured, the continuous prescription bag paper 90A is conveyed and printed continuously by the inkjet printer 100 having tractors 44.

Continuous paper R used in this inkjet printer 100 is not limited to the continuous prescription bag paper 90A described above. As shown in FIG. 5C, plain fanfold paper that has sprocket holes Q1 formed in a row along both y-axis edges 96*a*, 96*b* of the paper at a specific pitch along the x-axis, and can be pulled apart at perforations 94 rendered at specific intervals in the x-axis direction, may also be used.

Inkjet Printer Control

Figure 6:
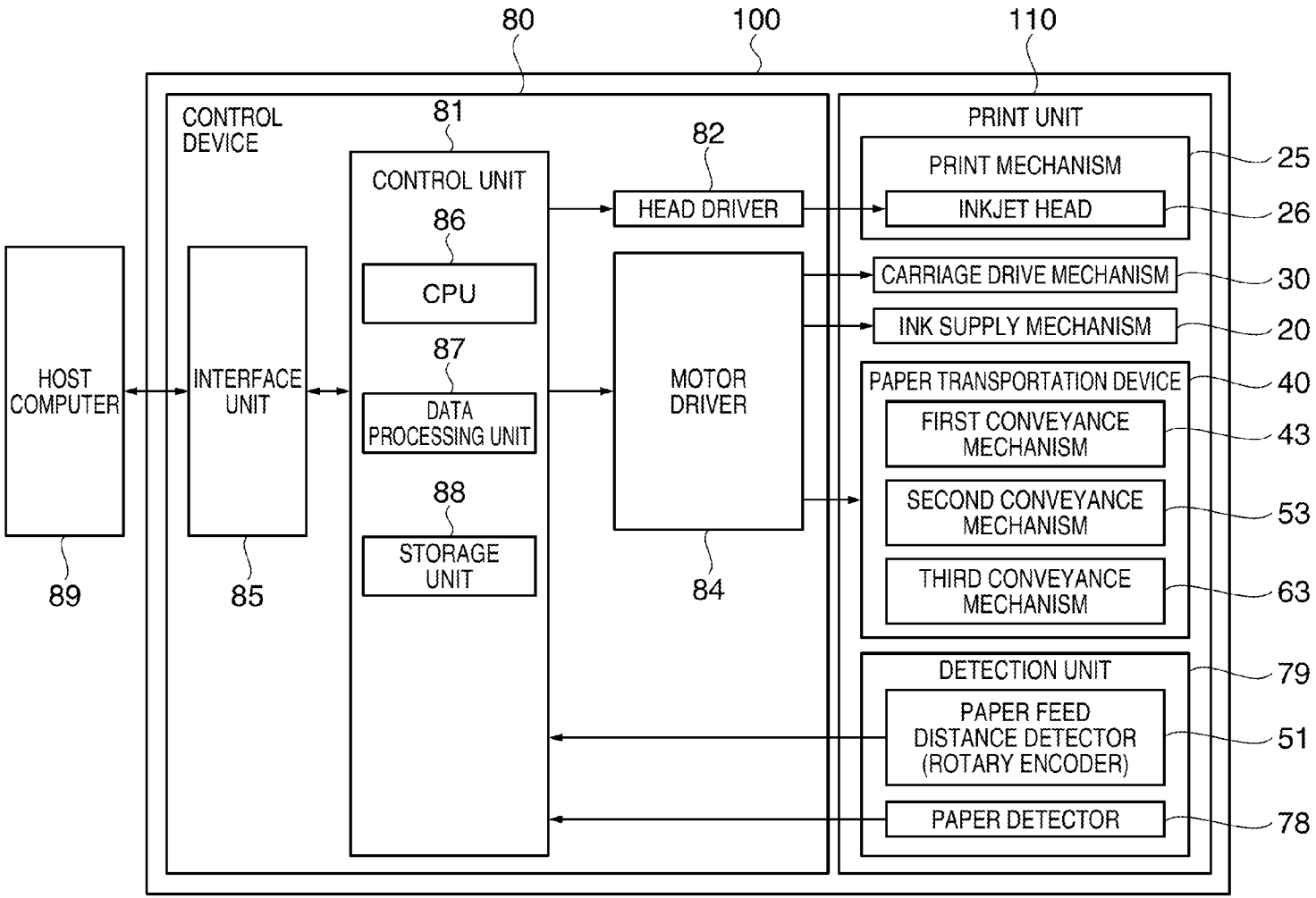
FIG. 6 is a block diagram showing the main components of the inkjet printer of FIG. 1.

The control system of the inkjet printer is described next with reference to FIG. 6. FIG. 6 is a block diagram showing the main components of the inkjet printer. As shown in FIG. 6, the inkjet printer 100 has a print unit 110 that includes a print mechanism 25 including the inkjet head 26, a carriage drive mechanism 30 including a carriage motor not shown, a paper conveyance device 40, and a detection unit 79 including a paper feed distance detector (rotary encoder) 51, and a control device 80 that centrally controls these other parts.

The control device 80 includes a control unit 81 that is the main part of the control system, a head driver 82 that controls driving the inkjet head 26, a motor driver 84 that drives the ink supply mechanism 20, paper conveyance device 40, and carriage drive mechanism 30, and an interface unit 85. The control unit 81 includes a CPU (central processing unit) 86, data processing unit 87, and storage unit 88. The CPU 86 executes processes including processing input signals from a detection system and an operating system not shown, and a printing process. The data processing unit 87 processes information.

The storage unit 88 is rendered by RAM (random access memory), ROM (read-only memory), or other device not shown. RAM is used to temporarily store print data and other data input from the host computer 89 through the interface unit 85, and temporarily stores printing process and other programs that are executed by the CPU 86. The print data describes the pattern to be printed on continuous paper R by the inkjet head 26.

The head driver 82 controls the inkjet head 26 based on commands from the CPU 86. The motor driver 84 individually controls the motors of the paper conveyance device 40 and carriage drive mechanism 30 based on commands from the CPU 86. The interface unit 85 outputs print data, for example, received from the host computer 89 to the control unit 81, and outputs data received from the control unit 81 to the host computer 89.

The inkjet printer 100 configured as described above prints on the continuous prescription bag paper 90A by alternately performing a paper feed operation that conveys the continuous prescription bag paper 90A in specific paper feed increments along the x-axis shown in FIG. 1 by means of the paper conveyance device 40, and a printing operation that prints by means of the carriage drive mechanism 30 moving the inkjet head 26 bidirectionally on the y-axis perpendicularly to the paper feed direction. The printed prescription bags 90 are individually separated at a perforation 94.

Inkjet Printer Operation

Figure 7:
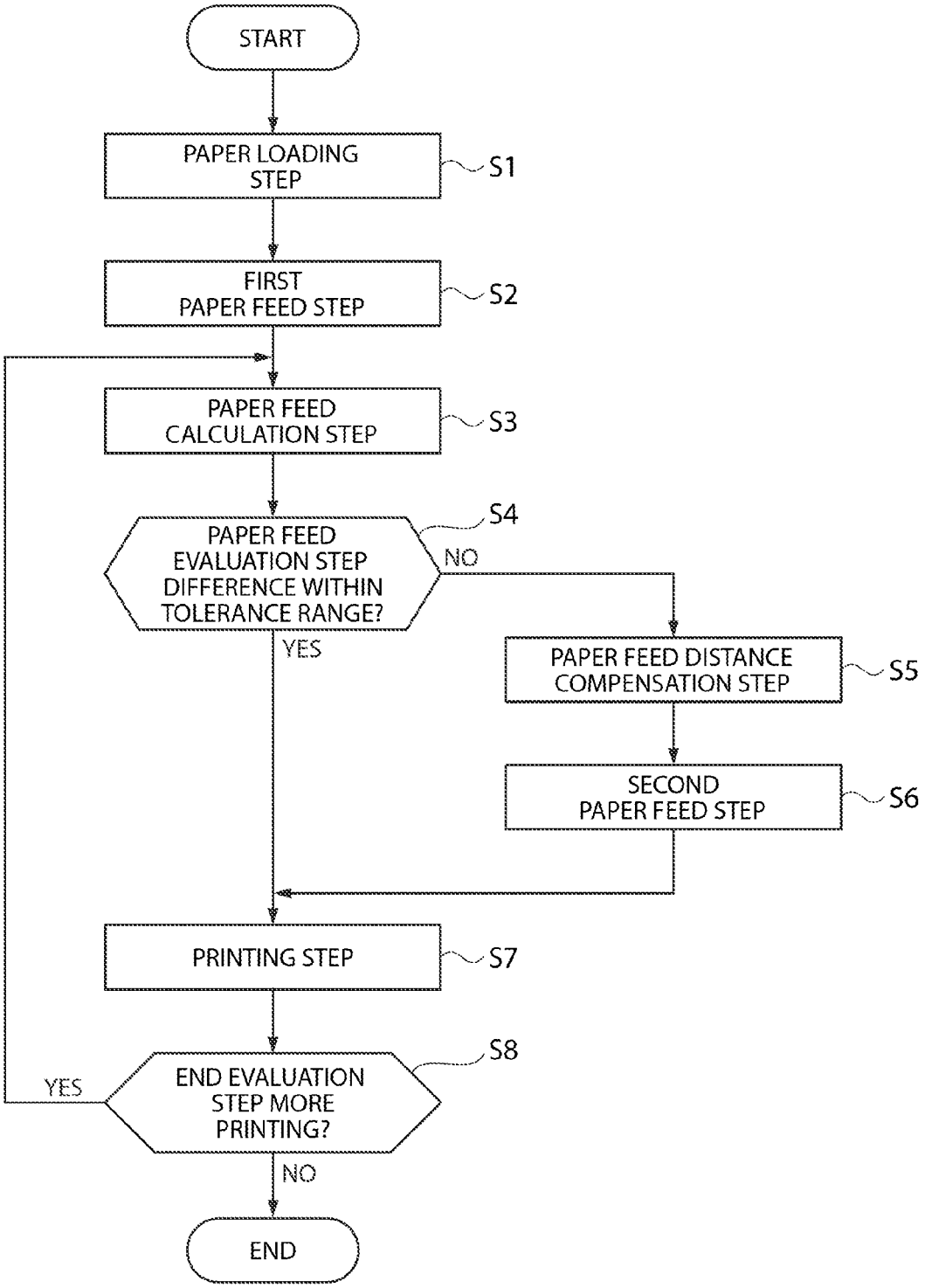
FIG. 7 is a flow chart showing the operation of the inkjet printer of FIG. 1.

The operation of the inkjet printer described above, and particularly the continuous paper conveyance method, is described next with reference to FIG. 7. FIG. 7 is a flow chart of inkjet printer operation. As shown in FIG. 7, inkjet printer 100 operation includes a paper loading step S1, first paper feed step S2, paper feed calculation step S3, paper feed evaluation step S4, paper feed distance compensation step S5, second paper feed step S6, and printing step S7. Operation using continuous prescription bag paper 90A as the continuous paper R is described by way of example below.

In the paper loading step S1 shown in FIG. 7, the continuous prescription bag paper 90A shown in FIG. 5B is set in the paper conveyance device 40 of the inkjet printer 100. More specifically, the sprocket holes Q1 formed along the edges 90*a*, 90*b* of the continuous prescription bag paper 90A are mounted on the tractor pins 45 that are formed on the tractor belts 46 of the tractors 44 as the first conveyance mechanism 43. At this time the leading end of the continuous prescription bag paper 90A is preferably set near the first paper feed roller 55 and the first pressure roller 58 of the second conveyance mechanism 53.

In the first paper feed step S2, the paper feed motor 72 is driven based on control signals from the motor driver 84 of the control unit 81 shown in FIG. 6, and drive power is transferred from the motor gear 71 shown in FIG. 4 through the toothed belt 74 to the drive gear 42 of the first conveyance mechanism 43 and the drive gear 52 of the second conveyance mechanism 53. Drive power is also transferred from the drive gear 52 of the second conveyance mechanism 53 to the drive gear 62 of the third conveyance mechanism 63. As a result, the tractor belts 46 turn, the tractor pins 45 of the tractor belts 46 sequentially engage the sprocket holes Q1 of the continuous prescription bag paper 90A, and the continuous prescription bag paper 90A is conveyed through the paper conveyance path 41.

The prescription bag 90 conveyed through the paper conveyance path 41 then reaches the second conveyance mechanism 53. The continuous prescription bag paper 90A reaching the second conveyance mechanism 53 is then conveyed by the rotating first paper feed roller 55 and first pressure roller 58 of the second conveyance mechanism 53, passes the printing position A of the inkjet head 26, and reaches the third conveyance mechanism 63. The continuous prescription bag paper 90A that reaches the third conveyance mechanism 63 is conveyed toward the paper exit 14 by the rotating second paper feed roller 65 and second pressure roller 68 of the third conveyance mechanism 63. More specifically, the continuous prescription bag paper 90A is conveyed through the paper conveyance path 41 by the paper conveyance force of the tractors 44 of the first conveyance mechanism 43, the first paper feed roller 55 and first pressure roller 58 of the second conveyance mechanism 53, and the second paper feed roller 65 and second pressure roller 68 of the third conveyance mechanism 63.

The leading end of the conveyed continuous prescription bag paper 90A is detected by the paper detector 78 disposed near the second paper feed roller 65, and then pauses while held by the first paper feed roller 55 and first pressure roller 58, and the second paper feed roller 65 and second pressure roller 68 of the third conveyance mechanism 63.

In the paper feed calculation step S3 shown in FIG. 7, the rotation of the first paper feed roller 55 during conveyance of the continuous prescription bag paper 90A in the first paper feed step S2 is detected by the rotary encoder 51 disposed to the drive gear 52 of the first paper feed roller 55 of the second conveyance mechanism 53 shown in FIG. 4. As described above, the drive gear 42 of the first conveyance mechanism 43 and the drive gear 52 of the second conveyance mechanism 53 are tensioned by the motor gear 71 and toothed belt 74 shown in FIG. 4. As a result, the actual paper feed distance Ta by the tractors 44 of the first conveyance mechanism 43, that is, the actual paper feed distance Ta of the paper conveyance device 40, is calculated by the rotary encoder 51. In addition, variation in rotation (the rotational state) of the first paper feed roller 55 whereby the continuous prescription bag paper 90A is conveyed while slipping can be known from the output or output interval of the rotary encoder 51. This calculation is done by the control unit 81 of the control device 80 shown in FIG. 6.

In the paper feed evaluation step S4 shown in FIG. 7, the actual paper feed distance Ta calculated in the paper feed calculation step S3 and the set paper feed distance Tb stored in the storage unit 88 of the control unit 81 are compared and the difference is calculated. The data processing unit 87 then determines if the difference is within the tolerance range. Whether variation in rotation of the first paper feed roller 55 is within the tolerance range is determined. If the difference and variation are within the tolerance range (YES), control goes to the printing step S7. If the difference and variation are not within the tolerance range (NO), control goes to the paper feed distance compensation step S5.

In the paper feed distance compensation step S5, the paper feed distance of the paper conveyance device 40 is corrected so that the difference and variation calculated in the paper feed evaluation step S4 can be eliminated in the next paper feed operation. As described above, the paper feed distance of the paper conveyance device 40 is based on the paper feed distance T1 of the tractors 44 of the first conveyance mechanism 43. If a feed distance greater than the tolerance range is detected, driving the paper feed motor 72 by means of a control signal from the motor driver 84 of the control unit 81 shown in FIG. 6, that is, movement of the tractor belts 46 of the tractors 44 of the first conveyance mechanism 43, is controlled to correct the paper feed distance of the continuous prescription bag paper 90A to eliminate the difference. In addition, if variation in rotation of the first paper feed roller 55 is significantly outside the tolerance range, a problem such as overload on continuous prescription bag paper 90A conveyance is detected and operator intervention is taken.

In the second paper feed step S6 shown in FIG. 7, the paper feed distance corresponding to the calculated difference is added to or subtracted from the paper feed distance Tc that was corrected in the paper feed distance compensation step S5, or more specifically the predetermined set paper feed distance Tb, and the paper is conveyed. Control then goes to printing step S7.

In the printing step S7, ink is discharged as ink droplets from the nozzles 27 of the inkjet head 26 onto the surface of the continuous prescription bag paper 90A conveyed through the paper conveyance device 40 while moving the inkjet head 26 bidirectionally on the y-axis perpendicularly to the paper feed direction by means of the carriage drive mechanism 30 of the print mechanism 25 to print information such as text or images. When printing one prescription bag 90 is completed, control goes to the end evaluation step S8.

Whether or not there is a next prescription bag 90 to print is determined in the end evaluation step S8. If there is not a next prescription bag 90 to print (NO), inkjet printer operation stops. If there is a next prescription bag 90 to print (YES), control goes to the foregoing paper feed calculation step S3 and the same operation described above repeats. The effect of this embodiment of the invention is described next.

(1) The paper conveyance device 40 described above includes the push-mode tractor feed (conveyance) of the tractors 44 of the first conveyance mechanism 43 for main conveyance. In addition to the push-mode tractor feed (conveyance) of the tractors 44, the paper conveyance device 40 also includes paper feed by means of the second conveyance mechanism 53 composed of the first paper feed roller 55 and first pressure roller 58 and the third conveyance mechanism 63 composed of the second paper feed roller 65 and second pressure roller 68 for secondary conveyance. In addition, in many embodiments, the relationship between the paper feed distance T and the paper holding force F of each paper feed mechanism, the paper feed distance T3 of the third conveyance mechanism 63>paper feed distance T2 of the second conveyance mechanism 53>reference paper feed distance T1 of the first conveyance mechanism 43, and the paper holding force F1 of the first conveyance mechanism 43>paper holding force F2 of the second conveyance mechanism 53>paper holding force F3 of the third conveyance mechanism 63.

As a result, while assuring the desired paper feed distance T1 and paper holding force F1 of the continuous prescription bag paper 90A by the first conveyance mechanism 43, the second conveyance mechanism 53 and third conveyance mechanism 63 feed the continuous prescription bag paper 90A by slightly greater paper feed distances T2 and T3, respectively. As a result, tension is applied to the conveyed continuous prescription bag paper 90A in the paper conveyance path 41 from the first conveyance mechanism 43 to the third conveyance mechanism 63 including the printing position A, and folds, wrinkles, and slack can be prevented at the perforations. The continuous prescription bag paper 90A can therefore be conveyed with little folding, wrinkles, or slack. An inkjet printer 100 that uses the paper conveyance device 40 can reduce loss of print quality caused by folds, wrinkles, or slack in the paper, and good print quality can be assured.

(2) The foregoing paper conveyance device 40 can be configured so that in the paper feed distance T relationship the paper feed distance T3 of the third conveyance mechanism 63>the paper feed distance T2 of the second conveyance mechanism 53>the paper feed distance T1 of the first conveyance mechanism 43. In the paper holding force F relationship, that is, the pressure applied by the first and second pressure rollers, the paper holding force F1 of the first conveyance mechanism 43>paper holding force F2 of the second conveyance mechanism 53>paper holding force F3 of the third conveyance mechanism 63. The continuous prescription bag paper 90A can therefore be conveyed the desired paper feed distance T1 by the tractors 44 of the first conveyance mechanism 43 while it slips at the second conveyance mechanism 53 and third conveyance mechanism 63 where the paper feed distances T are slightly greater, thereby maintaining tension overall and assuring the desired paper feed distance T1. As a result, variation in the paper feed distance T can be reduced. An inkjet printer 100 using this paper conveyance device 40 can assure paper feed precision and can assure good print quality.

(3) The paper conveyance device 40 can convey continuous paper R through the paper conveyance path 41 while applying specific tension thereto. As a result, in addition to plain perforated fanfold paper, continuous paper R composed of plural sheets of different materials, such as thick multipart fanfold paper and continuous prescription bag paper 90A composed of plural combined sheets, can be stably conveyed while reducing problems such as folds, wrinkles, and slack.

(4) The paper conveyance device 40 described above can detect the actual paper feed distance Ta of the tractors 44 of the first conveyance mechanism 43, that is, the actual paper feed distance Ta of the paper conveyance device 40, and rotation of the first paper feed roller 55, by means of an encoder 51. The actual paper feed distance Ta and slipping can therefore be monitored even in a configuration in which slipping is produced at the second conveyance mechanism 53, and the paper feed distance of the first conveyance mechanism 43 can be adjusted when a difference to the reference paper feed distance T1 occurs. As a result, the paper feed precision of the inkjet printer 100 can be assured.

A preferred embodiment of the invention is described above, but this embodiment can be modified in many ways without departing from the scope of the accompanying claims. Some examples of such variations are described below.

Variation 1

In the embodiment described above rotation of the first paper feed roller 55 of the second conveyance mechanism 53 is detected, the actual paper feed distance Ta is calculated, and the next paper feed distance T of the prescription bag 90 is adjusted in the first paper feed step S2 or printing step S7, but the invention is not so limited. When printing on prescription bag 90, the paper feed calculation step S3, paper feed evaluation step S4, and paper feed distance compensation step S5 may be performed. That is, if the paper feed calculation step S3 and paper feed evaluation step S4 are performed when conveying the paper one line or conveying one line space, and the difference between the actual paper feed distance Ta and the set paper feed distance Tb is greater than the tolerance range, the paper feed distance may be corrected in the paper feed distance compensation step S5 and the next line printed. This can further improve the paper feed precision of the inkjet printer 100.

Variation 2

The foregoing embodiment describes a configuration using a toothed belt 74, which is an endless belt with internal teeth, as the power transfer mechanism 70, but the invention is not so limited. A normal gear train may be used instead. In addition, an inkjet printer 100 is used as an example of a printer, but the invention is not so limited. The printer may be a dot impact printer, a solid font impact printer, or a thermal printer.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A paper conveyance device for a printing device having a print head that prints information on conveyed continuous paper, the device comprising:

a first conveyance mechanism that includes a tractor that sequentially engages holes formed in the continuous paper and conveys the continuous paper along a paper feed direction, a paper feed distance per unit time of the first conveyance mechanism being a reference paper feed distance per unit time;

a second conveyance mechanism that includes a first feed roller and a first pressure roller, the second conveyance mechanism being disposed between the first conveyance mechanism and the print head in the paper feed direction, a paper feed distance per unit time of the second conveyance mechanism being greater than the reference paper feed distance per unit time;

a third conveyance mechanism that includes a second feed roller and a second pressure roller, the third conveyance mechanism being disposed downstream in the paper feed direction from the print head, a paper feed distance per unit time of the third conveyance mechanism being greater than the reference paper feed distance per unit time; and a detector that includes a rotary encoder which detects a paper feed distance of the first conveyance mechanism and a rotation of the first feed roller, the paper feed distance of the first conveyance mechanism being adjusted based on the detected result;

wherein a maximum paper holding force of the second conveyance mechanism based on the paper feed distance per unit time of the second conveyance mechanism is greater than a maximum paper holding force of the third conveyance mechanism based on the paper feed distance per unit time of the third conveyance mechanism.

2. The paper conveyance device of claim 1, wherein the paper feed distance per unit time of the third conveyance mechanism is greater than the paper feed distance per unit time of the second conveyance mechanism.

3. The paper conveyance device of claim 2, wherein:

the first conveyance mechanism and the second conveyance mechanism are driven by a common drive source.

4. A printing device comprising:

the paper conveyance device of claim 3;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

5. The paper conveyance device of claim 2, wherein:

the first conveyance mechanism includes a first drive gear that drives the tractor;

the second conveyance mechanism includes a second drive gear that drives the first feed roller;

the common drive source includes a motor that drives a motor gear; and a single toothed belt is mounted on the first drive gear, the second drive gear, and the motor gear.

6. A printing device comprising:

the paper conveyance device of claim 5;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

7. A printing device comprising:

the paper conveyance device of claim 2;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

8. The paper conveyance device of claim 1, wherein the pressure of the second pressure roller on the second feed roller is less than the pressure of the first pressure roller on the first feed roller.

9. The paper conveyance device of claim 8, wherein:

the first conveyance mechanism and the second conveyance mechanism are driven by a common drive source.

10. A printing device comprising:

the paper conveyance device of claim 9;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

11. The paper conveyance device of claim 8, wherein:

the first conveyance mechanism includes a first drive gear that drives the tractor;

the second conveyance mechanism includes a second drive gear that drives the first feed roller;

the common drive source includes a motor that drives a motor gear; and a single toothed belt is mounted on the first drive gear, the second drive gear, and the motor gear.

12. A printing device comprising:

the paper conveyance device of claim 11;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

13. A printing device comprising:

the paper conveyance device of claim 8;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

14. The paper conveyance device of claim 1, wherein:

the first conveyance mechanism and the second conveyance mechanism are driven by a common drive source.

15. A printing device comprising:

the paper conveyance device of claim 14;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

16. The paper conveyance device of claim 1, wherein:

the first conveyance mechanism includes a first drive gear that drives the tractor;

the second conveyance mechanism includes a second drive gear that drives the first feed roller;

the common drive source includes a motor that drives a motor gear; and a single toothed belt is mounted on the first drive gear, the second drive gear, and the motor gear.

17. A printing device comprising:

the paper conveyance device of claim 16;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

18. A printing device comprising:

the paper conveyance device of claim 1;

a print head that discharges ink droplets onto the continuous paper conveyed by the paper conveyance device;

a carriage that carries the print head; and a carriage moving mechanism that moves the carriage bidirectionally in a direction perpendicular to the paper feed direction of the paper conveyance device.

* * * * *